US010040168B2

(12) United States Patent
Van Der Veen et al.

(10) Patent No.: US 10,040,168 B2
(45) **Date of Patent: *Aug. 7, 2018**

(54) STEPPED RETAINING RING

(71) Applicant: Applied Materials, Inc., Santa Clara, CA (US)

(72) Inventors: Shaun Van Der Veen, San Jose, CA (US); Steven M. Zuniga, Soquel, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/632,684

(22) Filed: Jun. 26, 2017

(65) Prior Publication Data

US 2017/0312882 A1 Nov. 2, 2017

Related U.S. Application Data

(63) Continuation of application No. 13/895,620, filed on May 16, 2013, now Pat. No. 9,694,470, which is a continuation of application No. 12/851,480, filed on Aug. 5, 2010, now Pat. No. 8,465,345, which is a continuation of application No. 11/549,622, filed on Oct. 13, 2006, now Pat. No. 7,789,736.

(51) Int. Cl.
*B24B 37/32* (2012.01)

(52) U.S. Cl.
CPC ..... *B24B 37/32* (2013.01); *Y10T 156/10* (2015.01)

(58) Field of Classification Search
CPC ..... B24B 37/32
USPC ..... 451/41, 285, 287, 288, 289, 397, 398
See application file for complete search history.

(56) References Cited

U.S. PATENT DOCUMENTS

| | | | | |
|---|---|---|---|---|
| 5,738,574 | A | 4/1998 | Tolles et al. | |
| 5,948,204 | A | 9/1999 | Maveety et al. | |
| 6,068,548 | A * | 5/2000 | Vote | B24B 37/32 451/287 |
| 6,186,880 | B1 | 2/2001 | Gonzalez et al. | |
| 6,251,215 | B1 | 6/2001 | Zuniga et al. | |

(Continued)

FOREIGN PATENT DOCUMENTS

| | | |
|---|---|---|
| CN | 2517109 | 10/2002 |
| CN | 2780407 | 5/2006 |

(Continued)

OTHER PUBLICATIONS

International Search Report and Written Opinion of the European International Searching Authority dated Aug. 10, 2007 for the International Application No. PCT/US2007/005251 filed on Mar. 2, 2007, 11 pages.

(Continued)

*Primary Examiner* — Eileen Morgan
(74) *Attorney, Agent, or Firm* — Fish & Richardson P.C.

(57) ABSTRACT

A two part retaining ring is described. A rigid upper portion has an annular recess along its inner diameter. An annular wearable lower portion has an inner diameter, an annular extension defined by the inner diameter and a vertical wall that is perpendicular to a surface of the second portion and opposite to the inner diameter. The annular extension fits into the annular recess of the annular first portion. A bonding material is on the vertical wall of the annular second portion.

14 Claims, 5 Drawing Sheets

(56) References Cited

U.S. PATENT DOCUMENTS

| | | | | |
|---|---|---|---|---|
| 6,824,458 | B2 | 11/2004 | Ensinger | |
| 6,913,665 | B2 | 7/2005 | Zurmuehle et al. | |
| 6,974,371 | B2 * | 12/2005 | Chen | B24B 37/32 451/285 |
| 7,094,139 | B2 * | 8/2006 | Marohl | B24B 37/32 257/E21.23 |
| 7,789,736 | B2 | 9/2010 | Van Der Veen et al. | |
| 8,465,345 | B2 | 6/2013 | Van Der Veen et al. | |
| 2004/0152403 | A1 * | 8/2004 | Marohl | B24B 37/32 451/442 |
| 2004/0219870 | A1 * | 11/2004 | Chen | B24B 37/32 451/422 |
| 2010/0303584 | A1 | 12/2010 | Van Der Veen et al. | |
| 2013/0231031 | A1 | 9/2013 | Van Der Veen et al. | |

FOREIGN PATENT DOCUMENTS

| | | |
|---|---|---|
| TW | 485089 | 5/2002 |
| TW | 200603348 | 1/2006 |

OTHER PUBLICATIONS

International Preliminary Report on Patentability in International Application No. PCT/US2007/005251, dated Apr. 23, 2009, 6 pages.

Chinese Office Action dated Apr. 13, 2010 for Application No. 200780038236.2, 5 pages.

Chinese Office Action dated Jan. 18, 2011 for Application No. 200780038236.2, 4 pages.

Taiwan Office Action dated Mar. 8, 2010 for Application No. 96107043.

Japanese Office Action dated May 10, 2012 for Application No. 2009-532338, 4 pages.

Chinese Office Action dated Apr. 16, 2013, for Application No. 201110234962.X, 5 pages.

Chinese Office Action dated May 16, 2014, for Application No. 201110234962.X, 13 pages.

* cited by examiner

STEPPED RETAINING RING

CROSS-REFERENCE TO RELATED APPLICATIONS

This application is a continuation of and claims priority to U.S. application Ser. No. 13/895,620, filed May 16, 2013, which is a continuation of U.S. application Ser. No. 12/851,480, filed on Aug. 5, 2010, now U.S. Pat. No. 8,465,345, which is a continuation of U.S. application Ser. No. 11/549,622, filed on Oct. 13, 2006, now U.S. Pat. No. 7,789,736, the entirety of which are incorporated by reference.

BACKGROUND

This invention relates to a retaining ring for use in chemical mechanical polishing.

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head of a CMP apparatus. The exposed surface of the substrate is placed against a rotating polishing disk pad or belt pad. The polishing pad can be either a standard pad or a fixed-abrasive pad. A standard pad has a durable roughened surface, whereas a fixed-abrasive pad has abrasive particles held in a containment media. The carrier head provides a controllable load on the substrate to push it against the polishing pad. The carrier head has a retaining ring which holds the substrate in place during polishing. A polishing liquid, such as a slurry, including at least one chemically-reactive agent and abrasive particles, is supplied to the surface of the polishing pad.

SUMMARY

In one aspect, a retaining ring is described. The retaining ring has an annular lower portion with a step along its inner diameter and an annular rigid upper portion with a recess along its inner diameter. The upper portion has a horizontal upper surface, the recess is defined by a vertical surface and the step is sized to fit into the recess. A bonding layer is between the step and the recess.

In another aspect, a retaining ring is described that has an annular lower portion and an annular rigid portion. The lower portion has an inner diameter $D_1$ and an annular step adjacent to the inner diameter $D_1$. The annular step has a height greater than a height of the lower portion at its outer diameter. The annular rigid portion has a lower surface and an inner diameter $D_2$ at the lower surface. $D_2$ is greater than $D_1$ and the lower surface of the annular rigid portion is adjacent to the annular lower portion. A bonding layer is between at least a portion of the inner diameter of the rigid portion and the lower portion.

In yet another aspect, a retaining ring is described that has an annular first portion and an annular second portion. The first portion has an annular recess along the inner diameter. The second portion has an inner diameter, an annular extension defined by the inner diameter and a vertical wall, which is parallel to the inner diameter. The annular extension fits into the annular recess. A bonding material is on the vertical wall of the second portion.

In one aspect, a system is described for chemical mechanical polishing. The system has a platen, a polishing article supported by the platen, a carrier head configured to apply a load to a substrate on the polishing article and a retaining ring attached to the carrier head. The retaining ring comprises an annular lower portion with a step along its inner diameter, an annular rigid upper portion with a recess along its inner diameter, wherein the recess is defined by a wall perpendicular to an upper surface of the upper portion and the step is sized to fit into the recess. A bonding layer is between the step and the recess.

In another aspect, a method for chemical mechanical polishing is described. The method includes applying a polishing solution to a polishing surface, retaining a substrate within a retaining ring with a surface of the substrate contacting the polishing surface and causing a relative motion between the substrate and the polishing surface. The retaining ring that is used comprises an annular lower portion with a step along its inner diameter, an annular rigid upper portion with a recess along its inner diameter, wherein the recess is defined by a wall perpendicular to an upper surface of the upper portion and the step is sized to fit into the recess. A bonding layer is between the step and the recess.

In another aspect, a method of forming a retaining ring is described. The method includes forming an annular lower portion, wherein the annular lower ring portion has a step along its inner diameter. An annular rigid portion is formed with a recess along its inner diameter, wherein the recess is defined by a wall perpendicular to an upper surface of the rigid portion and the step is sized to fit into the recess. A bonding material is applied to either of the lower portion or the rigid portion. The lower surface of the rigid portion is brought adjacent to the lower portion, causing the bonding material to contact both the upper portion and the lower portion. The bonding material is cured to form a bonding layer between at least a portion of the rigid portion and the lower portion.

Implementations of the invention may include one or more of the following features. The bonding layer can include an epoxy material, such as a material that includes a polyamide, or a polyamide and aliphatic amines. The bonding layer can have a thickness greater than 2 mils, such as between about 4 and 20 mils. The bonding layer can be between a horizontal surface of the upper portion and the lower portion. The bonding layer can have a substantially uniform thickness across a radial cross section of the retaining ring. The step can be an annular step. The lower portion can have a wearing surface that is opposite to its surface that is adjacent to the upper portion. The step portion can have a vertical wall that is parallel to the wall that defines the recess and the bonding layer can contact the vertical wall. All the surfaces of the lower portion that are opposite to the wearing surface can contact either the bonding layer or the annular rigid portion. The upper portion can have a projection that contacts the step. The projection can be an annular projection. The recess can be further defined by a horizontal lip adjacent to the inner diameter of the upper portion and the annular projection is adjacent to the horizontal lip. Alternatively, the annular projection can be non-adjacent to the horizontal lip. The upper portion and the lower portion can be free from recesses and corresponding steps that fit into the recesses, other than the recess adjacent to the inner diameter.

The implementations described herein may have one or more of the following advantages. A two part retaining ring with a bonding layer can prevent slurry from accumulating between the upper and lower parts of the ring. A bonding material, such as the ones described herein, can have superior resistance to chemicals, such as slurry and DI water, heat, and pressure. A projection in one of the ring parts can facilitate proper alignment of the two parts of the ring. A projection in one of the parts of the retaining ring can ensure a minimum epoxy thickness between the two parts of the ring. A bonded retaining ring with an annular step feature can have a cylindrical tangential edge contact area, whereby the radial space between the upper and lower rings is zero, thus resulting in zero epoxy thickness at only the tangential edge. A projection can provide even quantities of adhesive material around the retaining ring. A ring with a step feature has a greater surface area for bonding than rings with a flat interface. The greater amount of bonding material can provide a stronger adhesive bond. Additionally, the increased bonding surface area is towards the inner diameter of the retaining ring, where the highest stress level occurs. Further, the vertical bonding area may prevent the lower ring from delaminating from the upper ring at the inner diameter. The step feature and the projection may be load bearing. That is, the side load produced by the horizontal motion of the retaining ring as the retaining ring is pressed down against the polishing pad can be transferred through the features rather than through the adhesive. The rings described herein can be less prone to delamination. Because the rings are less likely to delaminate, the rings can have a longer useful life than a ring without the step feature.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
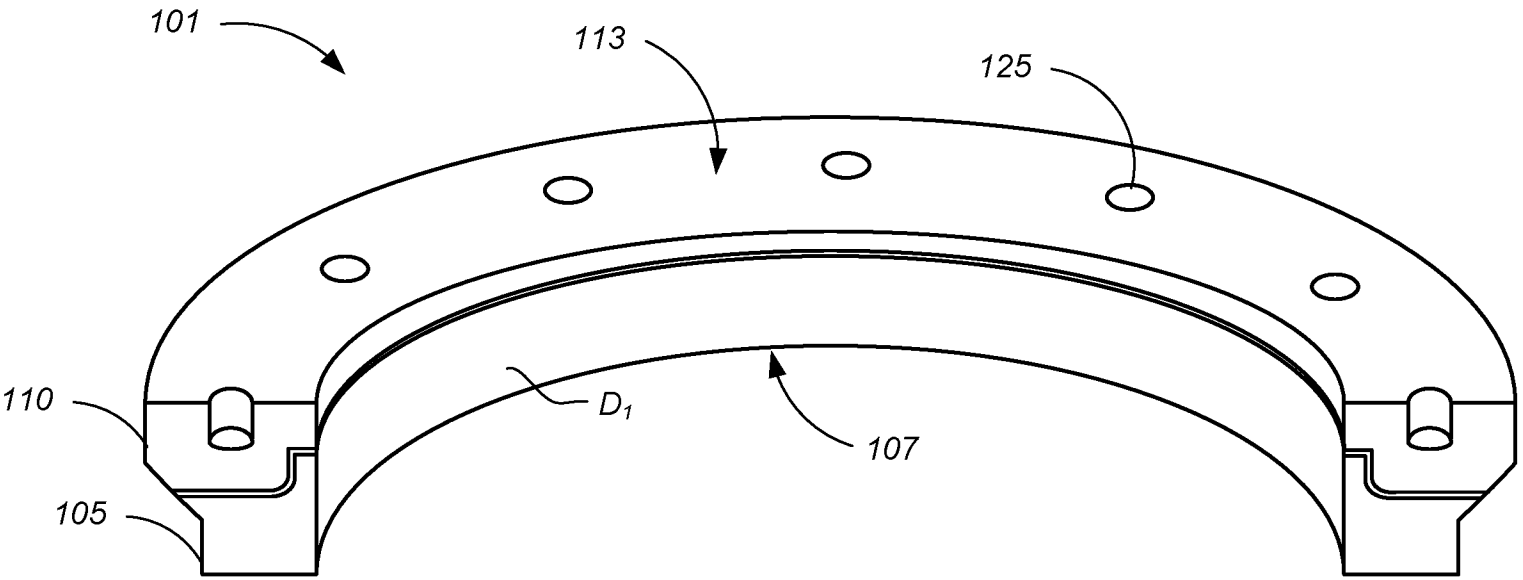
FIG. 1 shows a perspective, partial cross-sectional view of a retaining ring.

Referring to FIGS. 1-4, a substrate can be held by a retaining ring secured to a carrier head for polishing by a chemical mechanical polishing (CMP) apparatus. A suitable carrier head is described in U.S. Pat. No. 6,251,215. A description of a CMP apparatus may be found in U.S. Pat. No. 5,738,574, the entire disclosures of these references are hereby incorporated by reference.

The retaining ring 101 can be constructed from two rings, a lower ring 105 and an upper ring 110. The lower ring 105 has a lower surface 107 that can be brought into contact with a polishing pad, and an upper surface 108. The lower ring 105 can be formed of a material which is chemically inert in a CMP process, such as a plastic, e.g., polyphenylene sulfide (PPS), polyetheretherketone (PEEK), carbon filled PEEK, Teflon® filled PEEK, polyethylene terephthalate (PET), polybutylene terephthalate (PBT), polytetrafluoroethylene (PTFE), polybenzimidazole (PBI), polyetherimide (PEI), or a composite material. The lower ring should also be durable and have a low wear rate. In addition, the lower ring should be sufficiently compressible so that contact of the substrate edge against the retaining ring does not cause the substrate to chip or crack. On the other hand, the lower ring should not be so elastic that downward pressure on the retaining ring causes the lower ring to extrude into the substrate receiving recess.

The upper ring 110 of the retaining ring 101 can be formed of a material that is more rigid than the lower ring 105. The rigid material can be a metal, e.g., stainless steel, molybdenum, or aluminum, or a ceramic, e.g., alumina, or other exemplary materials. The upper ring 110 has a lower surface 112 and an upper surface 113.

The lower and upper rings 105, 110 together form the retaining ring 101. When the two rings are joined, the upper surface 108 of the lower ring 105 is positioned adjacent to the lower surface 112 of the upper ring 110. The two rings generally have substantially the same dimensions at the inner and outer diameters at their inner surface such that the two rings 105, 110 form a flush surface where the two rings 105, 110 meet when they are joined.

The upper surface 113 of the upper ring 110 generally includes holes 125, as shown in FIG. 1, with screw sheaths to receive fasteners, such as bolts, screws, or other hardware, for securing the retaining ring 101 to the carrier head. The holes 125 can be evenly spaced around the carrier head. Additionally, one or more alignment features, such as apertures or projections (not shown), can be located on the top surface 113 of the upper ring 110. If the retaining ring has an alignment aperture, the carrier head can have a corresponding pin that mates with the alignment aperture when the carrier head and retaining ring are properly aligned. In some implementations, the retaining ring 101 has one or more through holes (not shown) that extend from the inner diameter to the outer diameter for allowing slurry or air to pass from the interior of the ring to the exterior, or from the exterior to the interior, of the ring during polishing.

The two rings can be attached with an adhesive layer 215 in the interface between the two rings. The adhesive layer 215 can be a two-part slow-curing epoxy. Slow curing generally indicates that the epoxy takes on the order of several hours to several days to set. However, the epoxy curing cycle can be shortened with elevated temperature. For example, the slow curing epoxy may be Magnobond-6375™, available from Magnolia Plastics of Chamblee, Ga. Alternatively, the epoxy can be a fast curing epoxy. In certain implementations, the epoxy is a high temperature epoxy. High temperature epoxy resists degradation of the adhesive layer 215 due to high heat during the polishing process. In certain implementations, the epoxy includes polyamide, such as 60% to 100% polyamide, and aliphatic amines, such as 10% to 30% of a first aliphatic amine, and 5% to 10% of a second aliphatic amine. For example, the high temperature epoxy may be LOCTITE® Hysol®

E-120HP™ from Henkel Corporation of Rocky Hill, Conn. In particular, LOCTITE® Hysol® E-120HP™ better resists degradation as compared to other adhesives, and consequently reduced failure due to delamination. Degradation can be caused by high heat, fatigue, deionized water contact and absorption, and chemical attack from the slurry used in the polishing process.

The adhesive layer 215 between the two rings at the inner and outer diameters prevents trapping of slurry in the retaining ring. During polishing, the friction between the polishing pad and the retaining ring 101 creates a side load which can skew the lower ring 105. This action tends to pull the lower ring 105 away from the upper ring 110, creating a gap between the two rings. In addition, a side load caused by the substrate pushing against the inner diameter of the lower ring 105 increases the tension or peel force at the inner diameter of the retaining ring between the upper and lower portions of the retaining ring 101. The adhesive layer 215 between the upper and lower rings 105, 110 can prevent the slurry from entering the gap between the two rings or can prevent a gap from forming.

Figure 2:
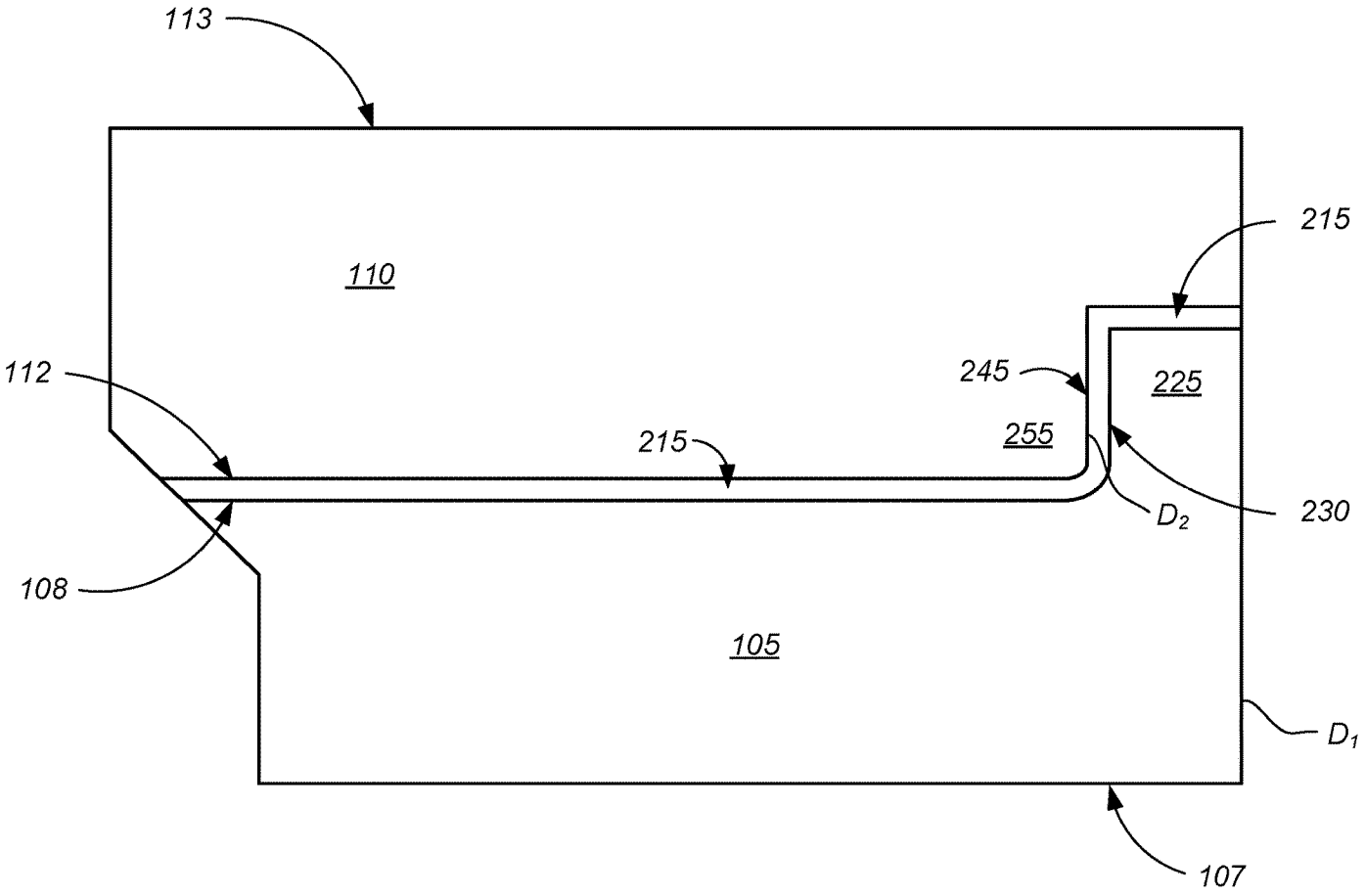
FIG. 2 shows a cross-section of one implementation of a retaining ring.

As shown in FIG. 2, the lower ring 105 has a step feature 225. The step feature 225 projects vertically from the lower ring 105 into a corresponding recess in the upper ring 110. The step feature 225 is an annular step adjacent to the inner diameter $D_1$ of the retaining ring 101. The step feature 225 extends upwardly from a horizontal portion of the lower ring 105. The step feature 225 shares the inner diameter wall of the lower ring's horizontal portion that is, the portion adjacent to lower surface 107. Opposite to the inner diameter wall on the step feature 225 is a vertical wall 230. In some embodiments, the vertical wall 230 is parallel to the inner diameter wall. In some embodiments, the vertical wall 230 curves. In some embodiments, the step feature 225 tapers. The recess in the upper ring 110 corresponds to the step feature 225, so that when the lower ring 105 and upper ring 110 are brought together, the step feature 225 fits into the recess of the upper ring 110. The upper ring 110 has a wall 245 that defines part of the inner diameter $D_2$ of the upper ring and faces the vertical wall 230 of the lower ring 105 when the two ring parts are brought together. Wall 245 defines a base 255 of the upper ring 110. In some implementations, the step 225 is only at the inner diameter of the lower ring 105 and is not at the outer diameter. That is, the ring 101 may have no other step and corresponding recess features other than the step 225 and recess at the inner diameter of the retaining ring.

In some embodiments, the step has a width along a radial cross section of the lower ring that is between about 10% and 30% of the width of the lower ring along the same radial cross section, such as between about 12% and 20% of the width of the lower ring. In some embodiments, depth of the recess is between about 10% and 40% of the depth of the upper ring 110, such as between about 20% and 30%. The step 225 can make up between about 50% and 90% of the height of the lower ring at the inner diameter, such as between about 70% and 90%.

In one embodiment of a retaining ring, the lower ring has a height at the inner diameter of between about 0.15 and 0.2 inches, such as about 0.175 inches. The step can have a height of about 0.12 and 0.17 inches, such as about 0.15 inches above the top surface of the lower ring. Thus, the step is at least 50% of the total height of the ring at the inner diameter. The width of the lower ring along a radial cross section can be between about 0.6 and 1.2 inches, such as about 0.92 inches. The width of the step can be between about 0.08 and 0.2 inches, such as about 0.13 inches. The depth of the upper recess in the retaining ring can be between about 0.1 and 0.3 inches, such as about 0.16 inches. The thickness of the upper ring can be between about 0.4 and 0.7 inches, such as 0.6 inches.

In general, conventional retaining ring have a flat interface between the upper and lower portions. Shear force generated during rotation of the retaining ring exerts force on a horizontal adhesive layer. In retaining ring 101, the step feature 225 transfers shear force into compressive force on the adhesive layer 215 along a vertical wall 230 of the step feature 225. The transfer of shear force to compressive force on the adhesive layer 215 reduces the likelihood of delamination of the lower ring 105 from the upper ring 110 that can occur in retaining rings without a step feature. Also, the lateral forces produced by the horizontal motion of the retaining ring relative to the polishing pad as the retaining ring is pressed down against the polishing pad is transferred from the lower ring 105 to the base 255 of the upper ring 110. In addition, the vertical wall 230 provides a greater bonding area for the adhesive layer 215 because of the increase of surface area in the interface. The larger bonding area also reduces the likelihood of delamination of the lower ring 105 from the upper ring 110. Further, the adhesive layer 215 along the vertical wall 230 absorbs stress resulting from uneven thermal expansion between material in the upper ring 110 (e.g., a rigid material such as stainless steel) and material in the lower ring 105 (e.g., a less rigid or more compliant material such polyphenylene sulfide). Again, the transfer of shear force to compressive force on the adhesive layer 215 reduces the likelihood of delamination of the lower ring 105 from the upper ring 110 that can occur in retaining rings without a step feature.

Figure 3:
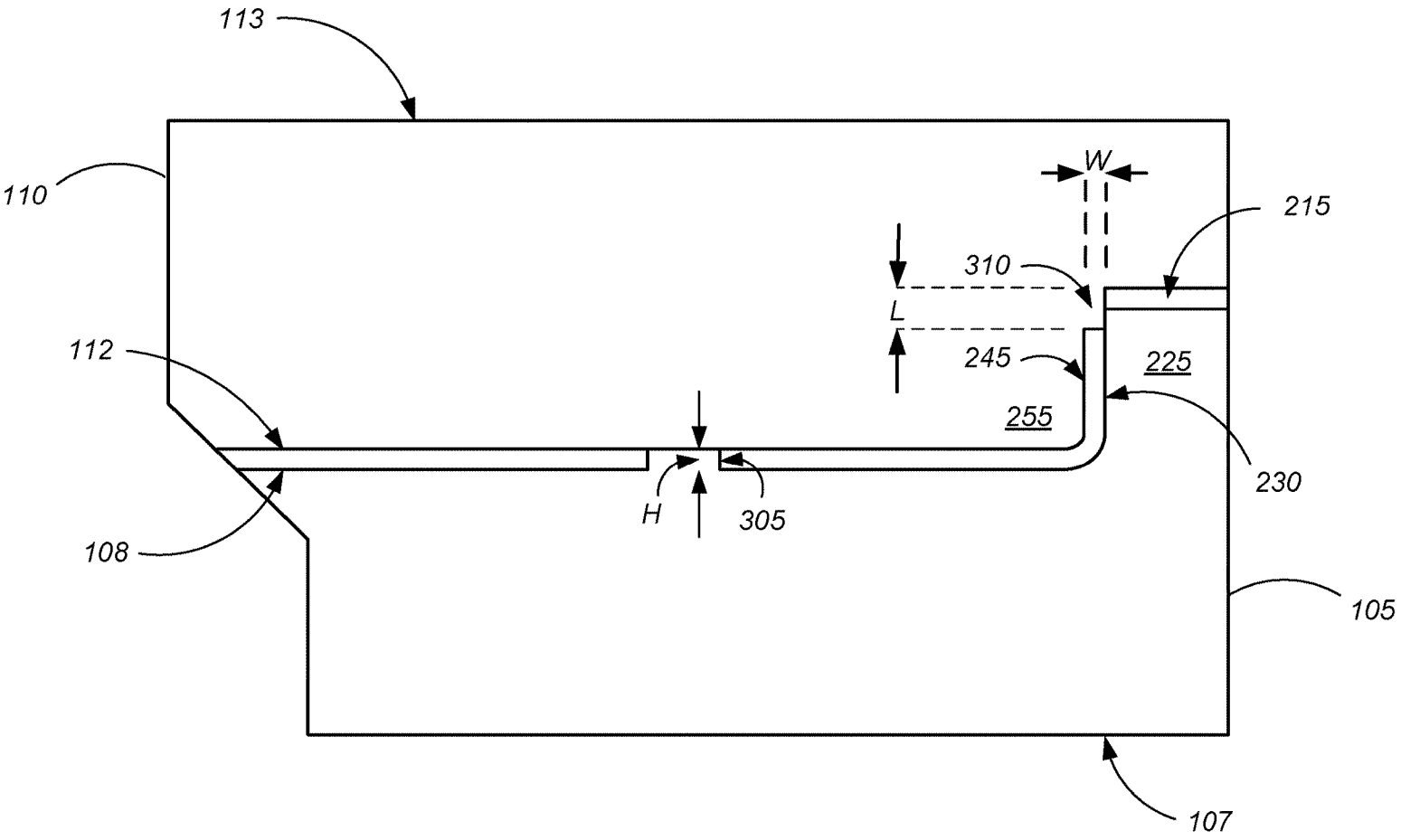
FIG. 3 shows a cross-section of one implementation of a retaining ring.

As shown in FIG. 3, in certain implementations, the lower ring 105 and/or the upper ring 110 includes projections 305 and 310, respectively. In some embodiments, the projections 305, 310 are annular and extend the entire way around the retaining ring. In other embodiments, the projections are spaced around the retaining ring, such as at equal angular intervals, for example, so that the bonding material can flow around the projections 305, 310, and air bubbles in the bonding material can be avoided. The projections 305 and 310 extend into the adhesive layer 215 between the two rings 105, 110. The surfaces of the projections 305 and 310 make direct contact with the surfaces 112 and 230, respectively. The width W of the projection 310 determines the thickness of the adhesive layer 215 in the vertical portion of the adhesive layer 215. The height H of the projection 305 determines the thickness of the vertically extending portion of the adhesive layer 215. Because the upper and lower rings 105, 110 can be formed by machining with reliable tolerances, the thickness of the adhesive layer 215 can be set consistently from retaining ring to retaining ring. In certain implementations, the thickness of the adhesive layer 215 between the two rings is between about 4 mils and 12 mils, such as between about 4 mils and 8 mils or 4 mils and 6 mils. The thickness can be selected based on the type of adhesive material used to bond the two rings together and the elastic modulus of the retaining ring material. The projection 310 can have any vertical length L, however the shorter the projection 310, the greater the length of the adhesive layer 215 in the area where the projection 310 is not located.

Figure 4:
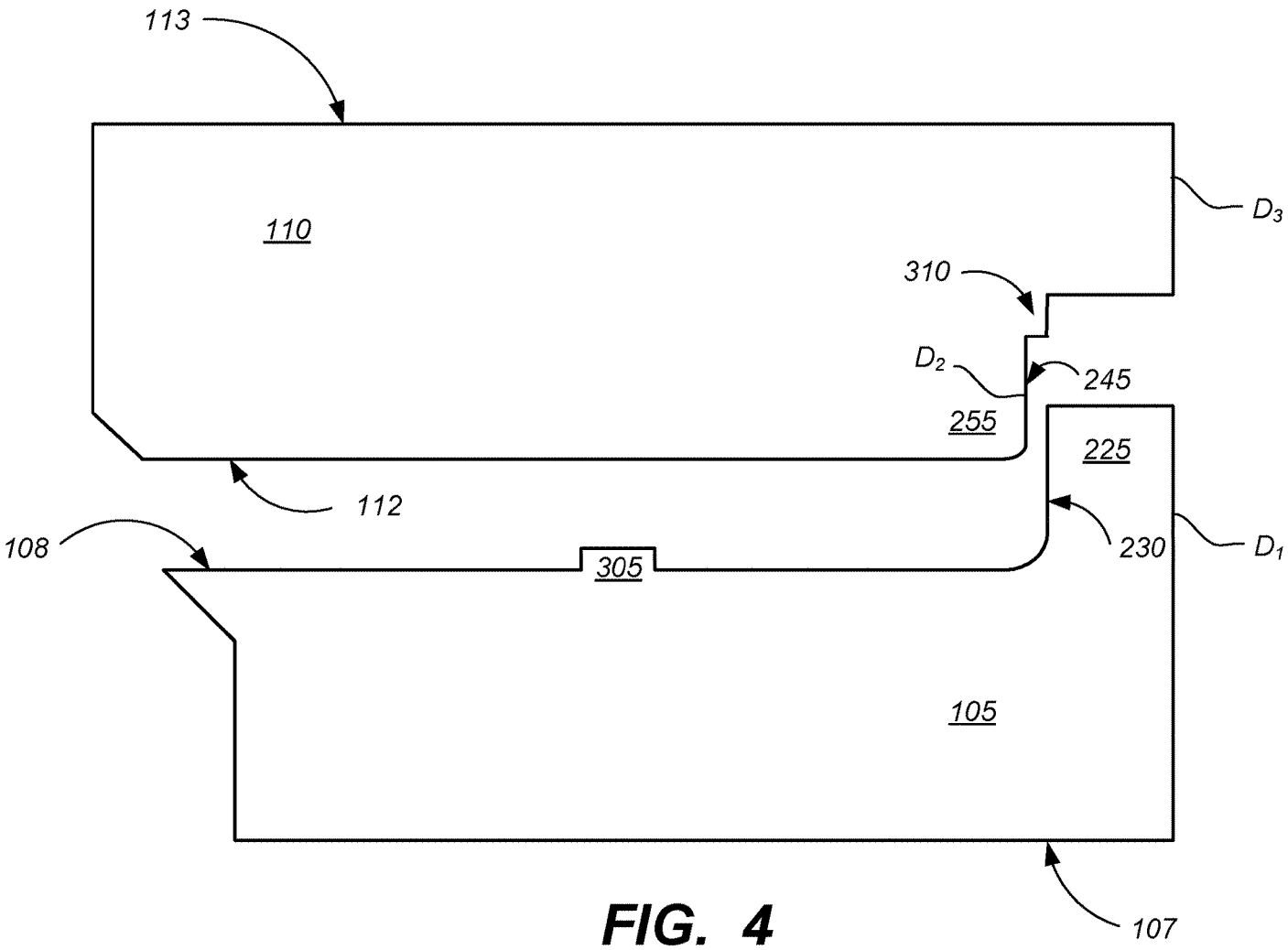
FIG. 4 shows cross-sectional profiles of the upper and lower portions of a retaining ring.

As shown in FIG. 4, the step feature 225 can be located on the upper surface 108 of the lower ring 105 such that the step 225 fits into the depression of the upper ring 110. In addition to the step feature 225, the retaining ring can have grooves on its bottom surface for transporting slurry into and out of the ring (not shown).

Figure 5:
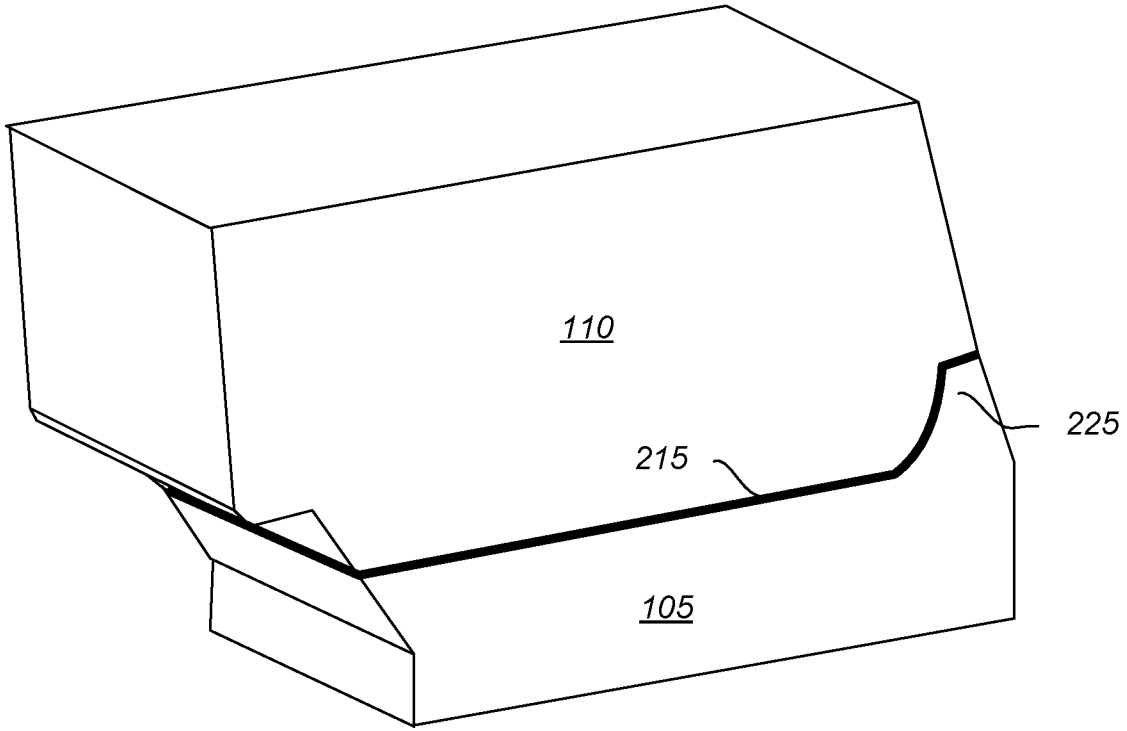
FIG. 5 shows a perspective cross-sectional slice of a retaining ring with a step.

Referring to FIG. 5, the wall of the step 225 that is opposite to an inner diameter of the retaining ring can be curved. In some implementations, the step 225 slopes inwardly or outwardly. Additionally, a part or all of the inner diameter of the retaining ring can be sloped. As shown, in some implementations, the lower ring 105 has a wall that is perpendicular to a wearing surface of the ring and then slopes so that the inner diameter of the retaining ring increases toward a top of the ring.

In one implementation, the two rings are both machined to have the features on their respective top and bottom surfaces 108 and 112. The adhesive layer 215 is applied to one of the surfaces, the two rings positioned so that the step feature 225 and the recess are aligned, and the rings are brought into contact with the top of the step feature 225 in the recess.

Once the two rings 105, 110 have been brought together to form the unitary retaining ring 101 and the adhesive is cured, the retaining ring 101 is attached to the carrier head 100. A substrate to be polished is transferred to within the recess of the ring 101, and the carrier head 100 applies a load to the substrate while the substrate undergoes motion relative to a polishing pad. As discussed above, the friction between the retaining ring 101 and the polishing pad can cause stress on the bond between the two portions of the retaining ring 101. However, by including the step feature 225, the risk of the bond delaminating and retaining ring failure can be reduced.

The features on the surfaces of the rings can provide one or more of the following mechanisms for reducing the incidence of delamination. First, a ring with a step feature has a greater upper surface area than a ring with a flat interface. The increased surface area increases the area where the adhesive is applied to the ring, and thus can produce a stronger adhesive bond. Second, the features are load bearing. That is, the side load produced by the horizontal motion of the retaining ring as the retaining ring is pressed down against the polishing pad can be transferred through the features rather than through the adhesive. Third, the step features can reduce stress caused by the different co-efficients of thermal expansion of the materials that form the upper and lower rings. Fourth, because the step features is at the inner diameter of the retaining ring, the step feature can help reduce the peel force between the upper and lower ring parts.

A number of embodiments of the invention have been described. Nevertheless, it will be understood that various modifications may be made without departing from the spirit and scope of the invention. For example, the annular projection 310 may be located in a position non-adjacent to the top of the step feature 225, such as opposite the middle of the vertical wall 230. In addition, the surfaces 108 and 112 may include more or fewer annular spacing projections. The outer diameter of the retaining ring can include a flange, as shown in FIG. 5 and as described in U.S. Pat. No. 7,094,139, which is incorporated herein by reference for all purposes. Accordingly, other implementations are within the scope of the following claims.

What is claimed is:

1. A retaining ring, comprising:

an annular lower portion of a first material, the lower portion having a lower surface to contact a polishing pad; and an annular upper portion of a different second material, the upper portion having an upper surface for attachment to a carrier head, the lower portion secured to the upper portion;

wherein a first portion selected from the group consisting of the lower portion and upper portion includes a projecting step positioned along an inner diameter of the retaining ring in a surface of the first portion, and a different second portion selected from the group consisting of the lower portion and the upper portion includes a recess positioned along the inner diameter of the retaining ring in a surface of the second portion with the step fitting into the recess, wherein a remainder of the surface of the first portion between the step and an outer diameter of the first portion is flat or has a projection that is shorter than the step, and wherein a remainder of the surface of the second portion between the recess and an outer diameter of the second portion is flat.

2. The retaining ring of claim 1, comprising a bonding layer securing the lower portion to the upper portion.

3. The retaining ring of claim 1, wherein the step is annular.

4. The retaining ring of claim 1, wherein the step includes a vertical wall on a side of the step closer to the outer diameter, and the recess includes a vertical wall on a side of the recess closer to the outer diameter, the vertical wall of the step being parallel to the vertical of the recess.

5. The retaining ring of claim 4 wherein a bonding layer is disposed between the vertical wall of the step being and the vertical wall of the recess.

6. The retaining ring of claim 5, wherein the bonding layer is additionally disposed between the remainder of the surface of the first portion and the remainder of the surface of the second portion.

7. The retaining ring of claim 4, wherein the surface of the second portion includes a lip in the recess adjacent to the vertical wall of the recess.

8. The retaining ring of claim 7, wherein the lip contacts the vertical wall of the step.

9. The retaining ring of claim 8, wherein the lip is annular.

10. The retaining ring of claim 1, wherein the remainder of the surface of the first portion between the step and the outer diameter of the lower portion is flat.

11. The retaining ring of claim 1, wherein the remainder of the surface of the first portion between the step and the outer diameter includes a projection that is shorter than the step.

12. The retaining ring of claim 1, wherein the step is at least half of a height of the first portion at the inner diameter.

13. The retaining ring of claim 1, wherein a width of the step is between about 10% and 30% of a width of the first portion.

14. The retaining ring of claim 1, wherein the second material is more rigid than the first material.

* * * * *